US006726063B2

(12) United States Patent
Stull et al.

(10) Patent No.: US 6,726,063 B2
(45) Date of Patent: Apr. 27, 2004

(54) SELF-CLEANING SHAPE MEMORY RETAINING VALVE

(75) Inventors: Gene Stull, Far Hills, NJ (US); Robert T Auer, E. Stroudsburg, PA (US)

(73) Assignee: Stull Technologies, Somerset, NJ (US)

( * ) Notice: Subject to any disclaimer, the term of this patent is extended or adjusted under 35 U.S.C. 154(b) by 0 days.

(21) Appl. No.: 10/116,366

(22) Filed: Apr. 4, 2002

(65) Prior Publication Data

US 2003/0189067 A1 Oct. 9, 2003

(51) Int. Cl.[7] ..... B65D 37/00
(52) U.S. Cl. ..... 222/212; 222/481.5; 222/494
(58) Field of Search ..... 222/212, 490, 222/494, 556, 575, 481.5

(56) References Cited

U.S. PATENT DOCUMENTS

| | | | | | |
|---|---|---|---|---|---|
| 1,989,714 | A | | 2/1935 | Statham | |
| 2,103,111 | A | * | 12/1937 | Ekdahl | 222/545 |
| 3,527,376 | A | | 9/1970 | Young, Jr. | |
| 4,749,108 | A | | 6/1988 | Dornsbusch | |
| 4,969,581 | A | * | 11/1990 | Seifert et al. | 222/212 |
| 5,033,655 | A | | 7/1991 | Brown | |
| 5,115,950 | A | | 5/1992 | Rohr | |
| 5,409,144 | A | | 4/1995 | Brown | |
| 5,676,289 | A | * | 10/1997 | Gross et al. | 222/494 |
| 5,927,566 | A | * | 7/1999 | Mueller | 222/490 |
| 5,971,232 | A | | 10/1999 | Rohr et al. | |
| 6,089,411 | A | * | 7/2000 | Baudin et al. | 222/212 |
| 6,089,418 | A | | 7/2000 | Gaiser et al. | |
| 6,089,419 | A | * | 7/2000 | Gross | 222/494 |
| 2002/0014499 | A1 | * | 2/2002 | Bonningue | 222/185.1 |
| 2002/0121530 | A1 | * | 9/2002 | Socier | 222/494 |

* cited by examiner

*Primary Examiner*—Joseph A. Kaufman
(74) *Attorney, Agent, or Firm*—Katten Muchin Zavis Rosenman

(57) ABSTRACT

A shape memory retaining valve for use with a flexible walled container and for dispensing product through the valve to form creative shapes and dispersions. In one embodiment, the valve is provided with an air passage such that when the container is capped, inward airflow continues allowing the container walls to recover their initial shape and reverse any container deformation occurring through product dispensing. When closed onto the container, a cap restricts the valve from opening out but does not restrict the valve from opening inwardly to let in air.

24 Claims, 10 Drawing Sheets

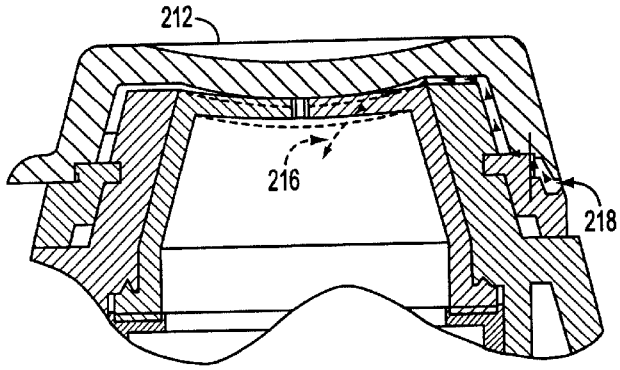
FIG. 3A
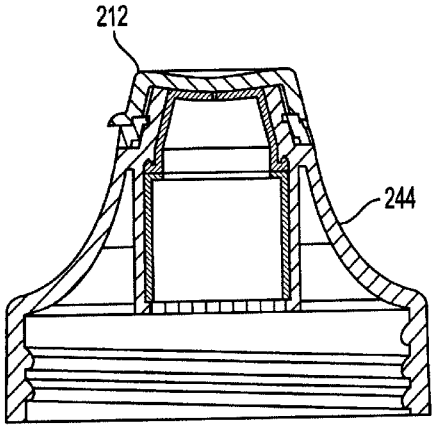
FIG. 3B1
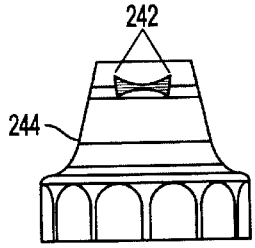
FIG. 3C1
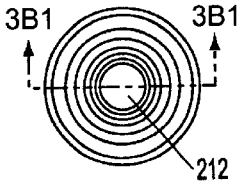
FIG. 3B2
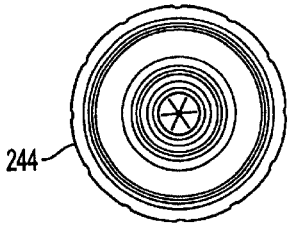
FIG. 3C2

SELF-CLEANING SHAPE MEMORY RETAINING VALVE

CROSS REFERENCE TO RELATED APPLICATIONS

None

STATEMENT REGARDING FEDERALLY-SPONSORED RESEARCH ON DEVELOPMENT

N/A

REFERENCE TO SEQUENCE LISTING

None

BACKGROUND OF THE INVENTION (1) Field of Invention

The present invention is directed to closures and valves and more particularly to a pressure-activated, self-cleaning shape memory-retaining valve.

(2) Description of Related Art and Information Disclosed Under 37 CFR 1.97 and 37 CFR 1.98

A drawback of known valve top dispensers is the sloppiness of the product dispensed as squeezed from a container well and the subsequent need to clean a cap opening following usage. Without cleanup or proper sealing, there is often left remaining mustard or other types of dispensable products, for example, from a squeeze bottle to dry atop the opening of a container and encrust unhygenically and unsightly, a problem resolved by the disclosed invention.

Thermoplastic Elastomer (TPE) and other material are a diverse family of rubberlike-materials that, unlike conventional vulcanized rubbers, can be processed and recycled like thermoplastic materials. They feature dynamic vulcanization: the process of intimate melt-mixing a thermoplastic polymer and a suitable reactive rubbery polymer to generate a thermoplastic elastomer with a chemically crosslinked rubbery phase, resulting in properties closer to those of thermoset rubber when compared to the same un-crosslinked composition.

TPEs provide functional performance and properties similar to conventional thermoset rubber products, but can be processed with the speed, efficiency and economy of thermoplastics.

In addition to simpler processing, principal advantages of TPEs compared to thermoset rubber products include easier recycling of scrap and closer, more economical control of dimensions and product quality.

Benefits of TPEs include improved cost/performance, design flexibility, reduced weight, wide service temperature range, ease of processing, superior product quality and dimensional consistency and in-house recyclability.

Object and Advantages

In one embodiment, a valve in conjunction with a flexible-walled container is intended to dispense product in an inverted position but is not limited to this position. The valve can be made from injection molded thermoplastic elastomer (TPE) or other material for ease of manufacture.

In one embodiment, the valve design disclosed provides the functional advantage of being self-cleaning from pressure-activated action based on the molded structure and memory of, for example, the (TPE) material it is comprised of.

Another object of the valve invention disclosed is that it can be utilized for all types of products, under varying conditions and varying amounts of material to be dispensed.

An additional object is the valve's ability to eliminate container paneling achieved in one embodiment by the flexibility of the valve and the design of the cover cap that is based on a one-way air passageway. An object of the invention is that the valve can be formed and assembled in several different ways and still achieves the same successful dispensing results. From a separate molded piece, the valve can be inserted on or inside a nozzle for example and then locked in place with a retainer. The injected molded valve can also be co-injected or insert molded directly and formed on or into the nozzle, when used with compatible material.

Other objects and advantages of the present invention will become apparent from the following descriptions, taken in connection with the accompanying drawings, wherein, by way of illustration and example, varying embodiments of the present invention are disclosed.

SUMMARY OF THE INVENTION

These and other objects of the invention, which shall become hereinafter apparent are achieved by a Self-Cleaning Shape Memory Retaining Valve. The valve has a self-cleaning and self-sealing shape, retaining initial molded shape memory following a pressure-activated deformation and is preferably comprised of selected material comprising injection molded thermoplastic elastomer (TPE) or material which retains initial molded shape following the deformation of the initial molded shape from the material flow pressure from the container. The valve has reduced or eliminated container paneling for the container further comprising a cover cap based on at least a one-way air passageway. Further the valve has at least a molded piece and is inserted proximate to a nozzle and has further a retainer for positional locking in one embodiment.

BRIEF DESCRIPTION OF THE DRAWINGS

The invention will be better understood by the Detailed Description of the varying embodiments, with reference to the drawings, in which:

FIG. 3A is an example of a side view of the valve showing an air intake valve, with an air way from an example position of the valve, with the cap in a down position to keep the valve from dispensing such that the valve flexes down and air is let in;

FIG. 3B1 is another example of the valve in position over a base cap with a top cover cap closed taken as a cross-section through line 3B1—3B1 of FIG. 3B2;

FIG. 3B2 is a top view of the valve with a cap in place;

FIG. 3C1 is a side view showing a ship and storage position with the base cap in position with, for example, two air slots;

FIG. 3C2 is a top view showing a valve without a cover cap in position;

DETAILED DESCRIPTION

Figure 1A:
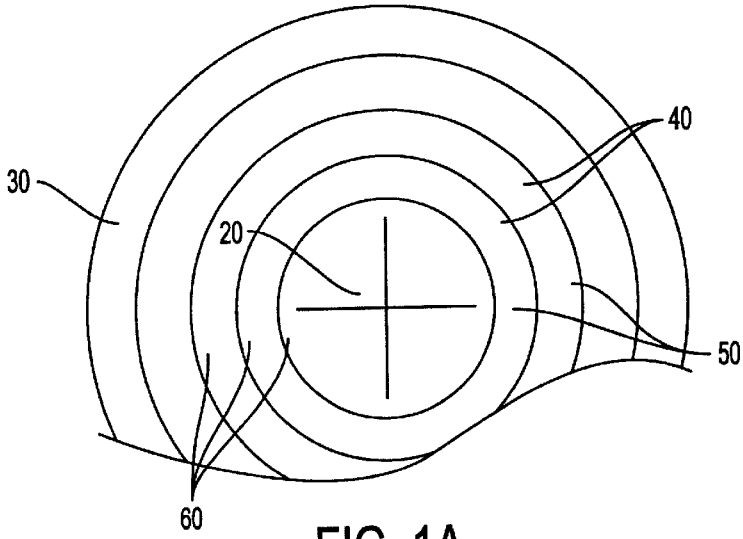
FIG. 1A is an example of a top view of the pressure-activated self-cleaning valve, with in one embodiment centermost slitting.

Referring now to the drawings wherein like numerals reflect like elements throughout the various views, in one embodiment, a valve can be formed with several rings of thick (60) and thin (40) wall sections as shown in FIG. 1A that are precisely spaced and formed to provide connecting circular hinges (50) controlled when external pressure is applied to the walls of a container.

In FIG. 1A, a top view of the "pressure-activated self-cleaning valve," is shown with the features of a center slit (20) with hinges (30) which are flexible. Across the valve is a thinned out ring area formed by the thin wall section (40) with circular hinged rings (50) formed as well.

The selection of a lower durometer TPE material, for example, enables and magnifies the valve's ability to expand and retract in a cycle (90) (FIG. 1.B) and seal with less external wall pressure.

Figure 1B:
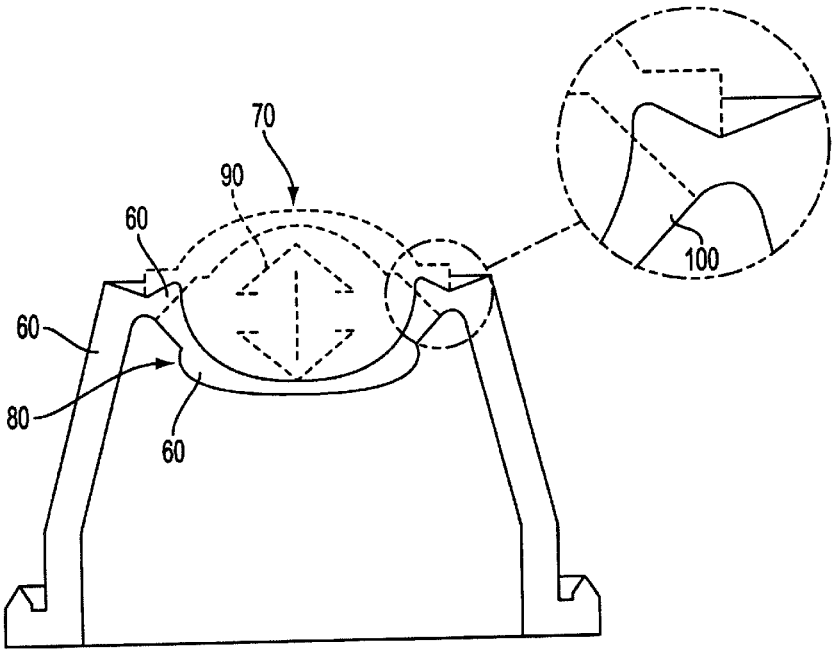
FIG. 1B is an example of a side view of the pressure-activated self-cleaning valve made from, for example, TPE for flexibility, with a "living" hinge flexible action shown activated from pressure upon the slitting.

FIG. 1B in a side view of the pressure-activated self-cleaning valve which shows here a thickened ring area (60). The FIG. 1B shows the valve convex (70) and the valve concave retracted (80) and the up and down action of circular hinged rings (90). An exploded view action of the hinged swing rings is shown.

Each of the molded rings within the valve disclosed is synchronized to perform a specific function when external pressure is applied to the walls of the container. The circular rings within the valve become flexible and expandable "living" hinges (100) as shown in FIG 1B. The expansion of the valve controls the product to be dispensed by insuring that the entire center section of the valve becomes convex (70), enabling the slit (20) in one embodiment or perforated holes in another embodiment to stretch and expand open. When the slits are forced into the expanded convex position (70), they are unlocked and able to open outwardly. This transition reverses the angles created by the expanded convex shape (70). Perforated holes or slits that are normally self-sealing in the concave (80) position of the disclosed invention stretch open and dispense when in the convex (70) or outward position. Variation of valve design affects the tooling layout, valve size, molded slit, slitting or piercing operation of the valve and placement of the gate for an infinite variation of dispensing possibilities.

Figure 2:
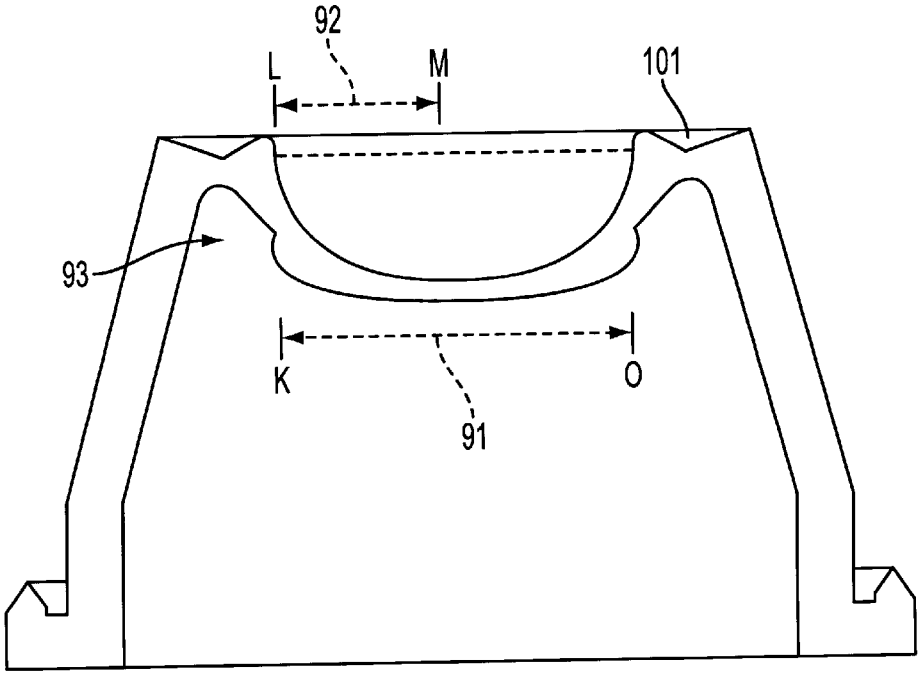
FIG. 2 is an example of a side view of the valve shown from an example with hinged rings in a concave position.

FIG. 2 is a Side View of the pressure-activated self-cleaning valve showing a spherical radian surface (91) of the underside of the valve. This radian can be spherical as shown on the subsequently flat varying radian diameter (92) as shown by element 92 between points L and M with varying offset (93) for this example of the valve having as well exterior sharp corners (101) as shown in this example embodiment.

After dispensing, for example, the valve snaps back almost immediately, thus cutting off the product flow caused by the rebound of the container walls reforming to the original molded state. During this transition of retraction to the concave (80) position, leftover product within the center of the outer valve is drawn back and sucked into the main container in one embodiment. This self-cleaning action is possible due to the valve's ability to open inwardly even with the cover cap in place (see FIG. 3C1 and FIG. 4).

FIG. 3A is a side view air intake valve with, in one embodiment, a cap, here as shown with the cap (212) in the down position-keeping valve from dispensing. As shown, the valve can flex down (216) to allow air flow in the valve through an air way (218).

FIG. 3B2 shows a top view, with the cap (212) in place. FIG. 3B1 shows top cap (212) in place, as a cross-sectional view taken through line 3B1—3B1 of FIG. 3B2.

For example as shown in FIG. 3C1, a side view is presented showing a ship and storage position with the base cap in position with, for example, two air slots 242, with FIG. 3C2 providing a top view showing a valve without a cover cap in position.

FIG. 3C2 provides a top view of the valve without a cover cap in place. FIG. 3C1 shows a side view of the valve with cap (212) in position the top cover cap (212) and valve in a ship and storage position with air slot(s) (242) can be provided as part of the valve above the base cap (244).

Figure 4:
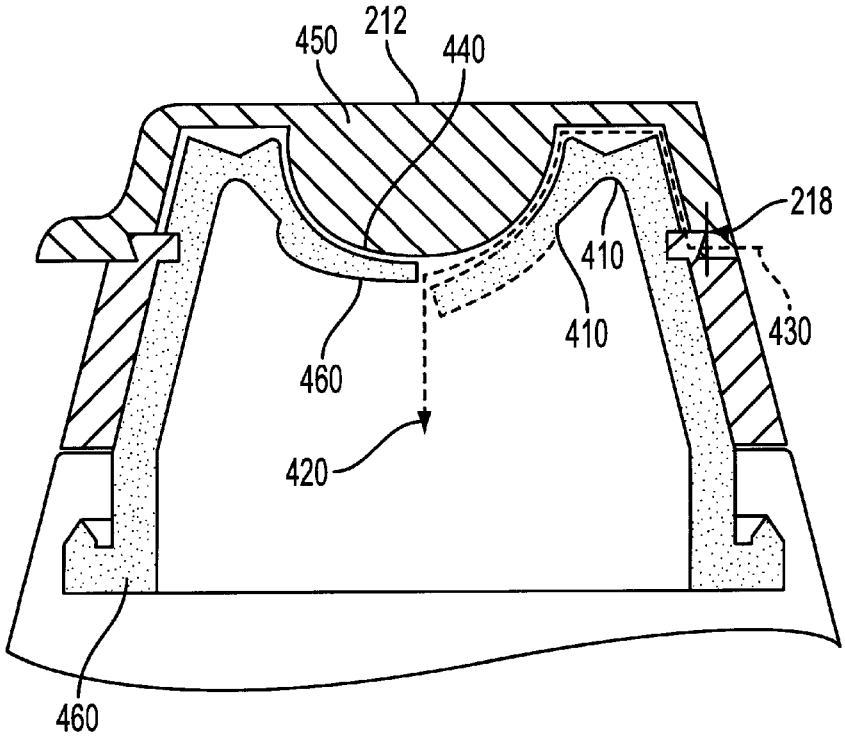
FIG. 4 is an example side view of the pressure-activated intake valve.

FIG. 4 is side view of the pressure-activated intake valve showing the valve with a cap in place such that the inner portion of the cover cap acting with the valve which is stopped from opening outwardly; the concave valve "living hinges" extending with the valve open concavely inwardly with air flow provided.

FIG. 4 shows a side view embodiment of the pressure-activated air intake valve with the flexible hinge(s) (410) flexing such that the concave valve opens inwardly (420). Air flow (430) is shown thru the airway (218) with cap (212) stopping the valve from opening outwardly with the inner portion (450) of cover cap (212) over the (460) valve.

After dispensing the product, the self-cleaning valve action can be assisted if the container is placed or held in an upright position or placed on a level surface during the container sidewall recovery, thus allowing product to clear. The container walls reform outwardly to a normal molded position after being squeezed, creating a reverse airflow that refills the vacated inner container space. The cleaning action is automatic after each squeeze of the container as part of the valve retraction cycle. During retraction of the reverse airflow, as the valve returns to the concave (80) position, the base pocket of the valve is sucked back into the container walls and its original shape. In the absence of negative or positive pressure on the container, the valve will automatically return to its original molded shape. The valve has excellent resiliency to environmental factors such as temperatures, altitudes, and material product variations of consistency.

Molding the slit, cutting or piercing operations can be done in the mold during or after the assembly process of the disclosed invention. In one example, the molded valve composed from TPE can take up to twenty-four hours of cure time before slitting. In some instances, slitting the valve prematurely can produce a substandard valve and prevent proper sealing. The type of slit or piercing along with the durometer of the (TPE) material is determined by the type of product to be dispensed. The valve, when used with a flexible walled container, can work very well with thinner valve walls and a lower durometer of (TPE) materials as well.

When dispensing liquids, lower durometer (TPE) is much easier to flex as it requires much less hand strength and enhances the economics of the valve for a larger market. More extreme environments present unique conditions, causing products to thicken or become thinner. Products that are kept in the refrigerator and left out for a time may change qualitatively in the way they dispense along with the hand pressure required to dispense. Certain products may require a special slit, slit length, special slit shaping (variations are shown throughout FIGS. 9 and 10) or softer durometer based on changing environments, which can easily be configured and foreseeable for the disclosed invention.

Figure 9:
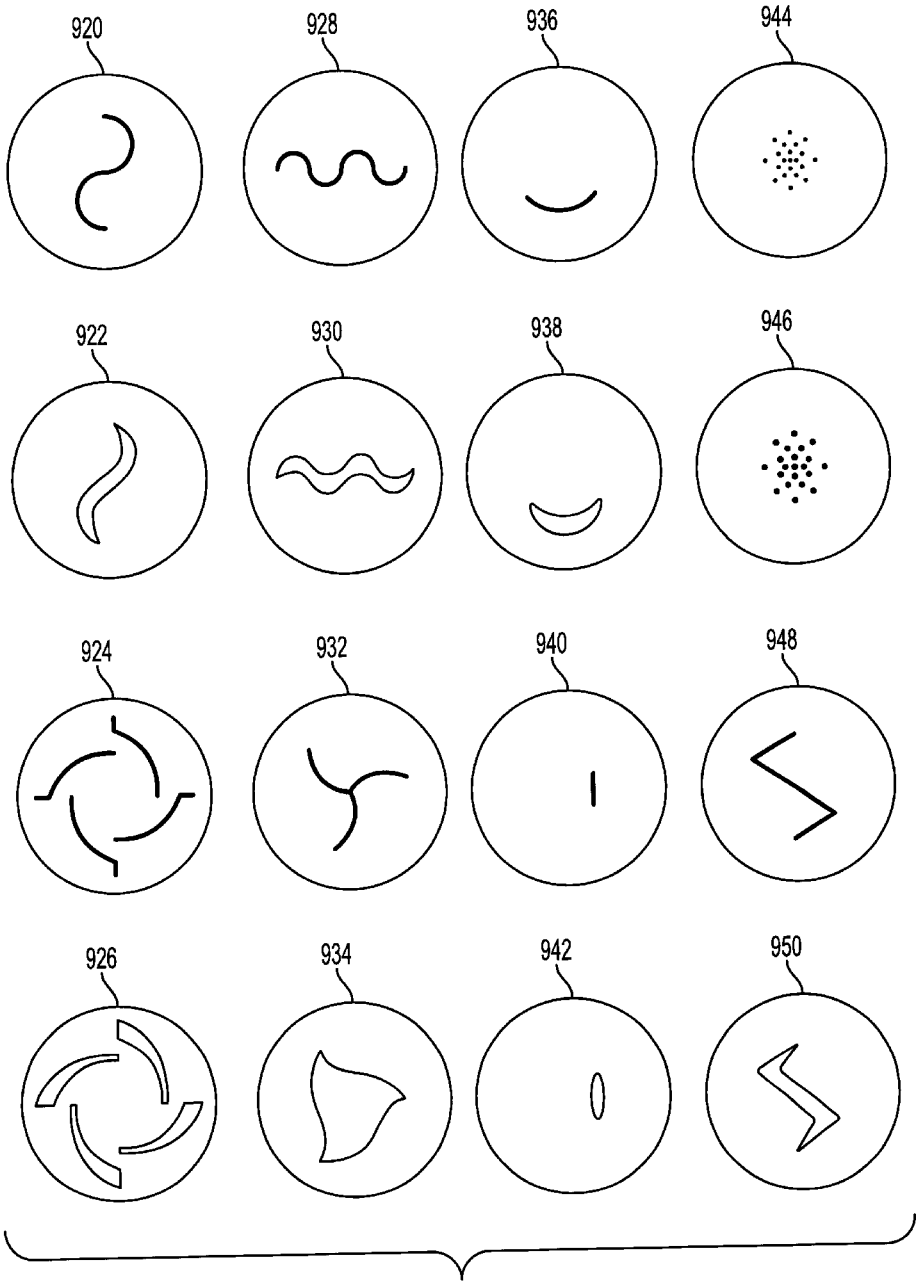
FIG. 9 shows variations of the directional dispensing valves with variant shapes of open and closed positions.

As shown in FIG. 9, variations of the directional dispensing valves, with variant shapes of open and closed positions can direct material flow creatively from valve formation variation. For example a closed position directional dispensing valve shape variation of opposite curves is shown (920). The (922) open position directional dispensing valve shape variation is then shown. A closed position (924) four curve slit is shown in open position (926). A closed position (928) wave curve is shown in the open position (930). A wider curve set is shown in a closed position (932) and in an open position (934). A closed position (936) off-center curve is shown achieving a semi-lunar open position (938). A closed position (940) narrow short slit is shown, followed by a semi-oval open position (942) as well as the closed position (944) centralized variation of holes is shown in an expanded open position (946). A closed position zig zag (948) is shown in an open position (950) for zig zag dispensing material as well.

Figure 10:
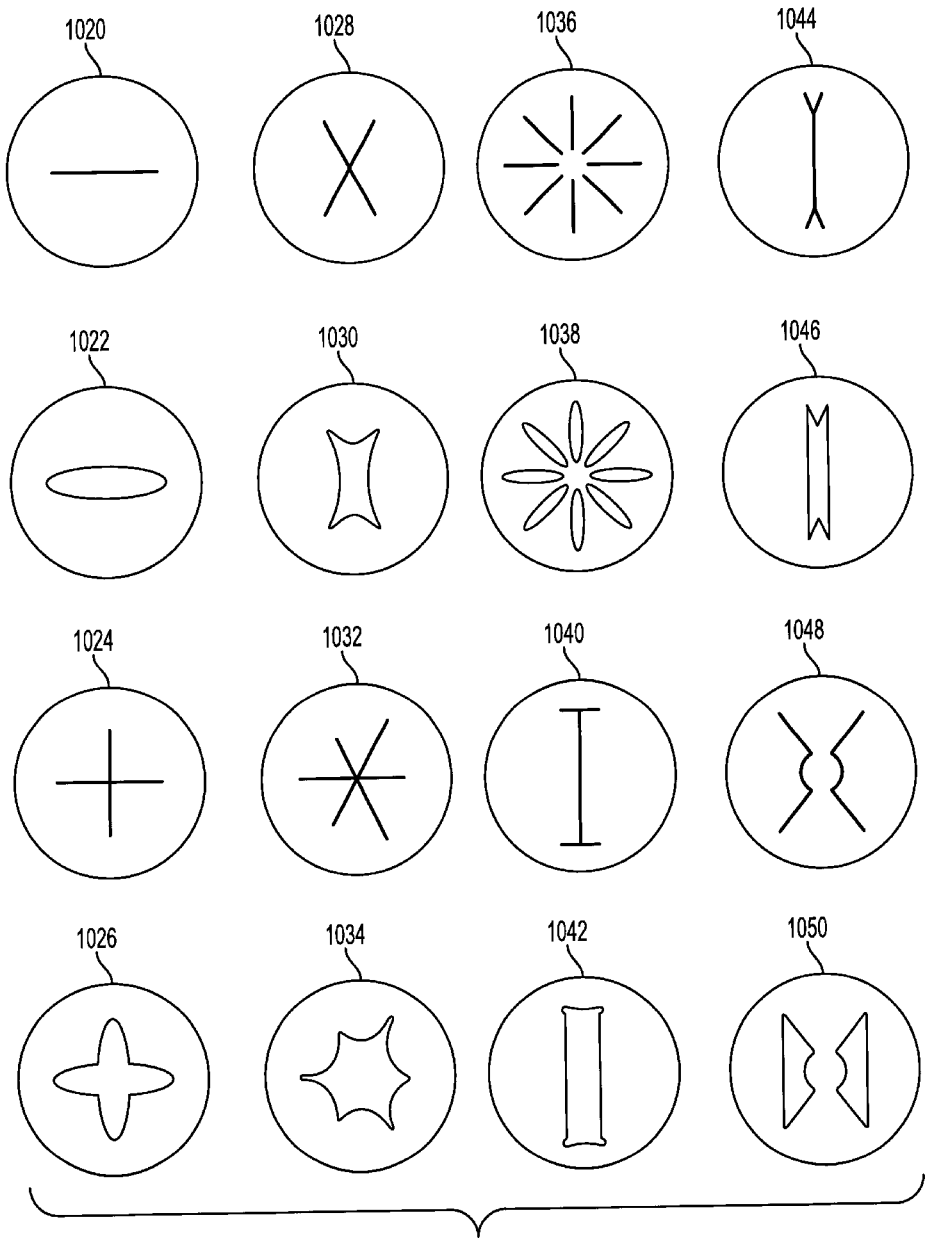
FIG. 10 shows variations of the equalized dispensing valves with variant shapes of open and closed positions.

As shown in FIG. 10, variations of the equalized dispensing valves with variant shapes of open and closed positions are shown such that if the slit or perforations are in the exact center of a valve face, then a gate will be placed slightly off center. If the slit or perforations are off center then the gate can be centered. FIG. 10 shows equalized dispensing valves variation samples. For example, a closed position shape valve variation of a center single slit opens to an open position (1022) shape valve variation of semi-oval shape. A closed position (1024) cross slit achieves a four point "petal" open position (1026) for dispensing. An X-shaped closed position slitting (1028) of equalized dispensing achieves an open position four pointed polygonal (1030) for dispensing material. A variation of closed position slit centering achieves a form of multi-inverted curve (1032) shown in an open position (1034). A closed position burst stifling (1036) achieve a flower petal open position shape (1038) distribution. A closed position (1040) "I"-variation slitting achieves an open position (1042) rectangular dispensing variation. A closed position (1044) "transom" slitting achieves a semi-rectangular open position (1046) for dispensing. A closed position dual "mountain" profile slitting (1048) achieves an open position (1050). The number of novel unique shape dispensing configurations due to unique valve variation equalized shape for dispensing is multifold.

Some (TPE) material is listed with extremely high mold shrinkage rates. The differential can be as much as 39% or more in ("X") direction of flow, versus the ("Y") direction transverse to material flow direction. This differential can affect the valve's basic ability to function, as it creates integral stresses within the wall structure itself. The stress factor becomes even more apparent after slitting and dispensing various products. The gate placement and size as earlier shown in FIGS. 9 and 10, is a factor in creating a valve with similar amounts of material stress within the face of the valve. Extreme wall stress variations cause the valve slit to open on one side first and close last, creating an uneven dispensing challenge. In some cases, the unequalled stress factors will cause one side or section of the same valve to be stronger or weaker compared to the other. Because the slit material could be expanding and flexing more on one side, the product will be forced to dispense unevenly. Slitting the valve off-center or placing the slit closer to one sidewall will also produce uneven dispensing and product cut-off.

Molding slits can be designated to close after the initial molding process, based on the material flow, directional shrinkage and gate positioning.

Figure 8:
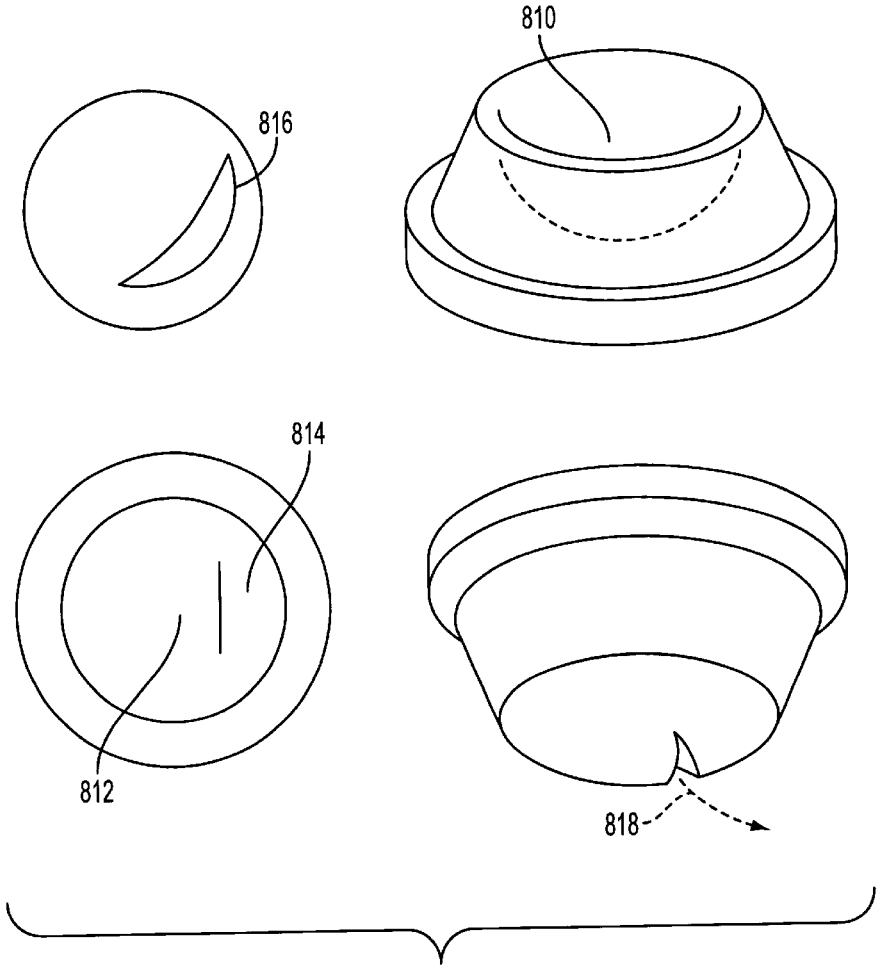
FIG. 8 shows a valve formation variation, with a valve of unequal sides with a lunar dispensing shape.

Additionally FIG. 8 shows an example of dispensing shape embodiment with the directional side dispensing created by unequal sides getting and slitting. The center gate of this embodiment (810) has a weak side (812) strong side (814) dispensing shape embodiment (816) achieving dispensing (818) with the off center slit dispensing material flow to the strong side (814).

This kind of wall imbalance will cause product to be dispensed toward the strong side because of the weak flap or fingers opening first and wider, forcing the product in a diagonal or angular dispensing pattern. FIG. 8 shows a valve formation variation, with a valve of unequal sides having a lunar dispensing shape 816. This configuration creates a shaped dispensing (818) pattern with the slit off the center gate of the valve (810). The controlled direction of material dispensing to the strong side (814) of the valve is away from the weak side (812) of the valve and expands and dispenses (818) with unequal curved flaps 816, creating a directed action upon material flow from the difference of flexing of the stronger side (814) and the substantially weaker side (812) flexing unequally on expansion of the valve (818) dispensing. When the valve closes and the product is shut off by the weak side of the slit, angular dispensing becomes most obvious at this point.

Curved slits or flaps will produce turning or circular dispensing patterns because of the unopposed forces of the expanded directional flap opening and closing. Irregularities around the slit are magnified because of the expansion and stretching of the (TPE) material. Slitting or piercing concave valves on the side wall radius result in product being dispensed away from center because of the valve expandings and reversing, becoming concave. Valves which are not cut or slit cleanly have a tendency to "hang-up" and not open and close smoothly and product leakage is more likely. Unintended "side" dispensing can also be caused by one side of the slit or flap not being neutralized by an equal force or identical isometric flap on the exact opposite 180° side.

The dispensing direction of the valve is controlled by the material's ability to expand and recover simultaneously, including the slits (20) or flaps. In one embodiment, by placing the gate directly in the center of a round valve produces equal stresses—that is, if the wall thickness is generally consistent and isometric. Slitting directly across the molded gate mark is not generally preferred, nor center gating as it can sometimes cause the slit to hang-up and not open or close properly.

In another embodiment, by placing the gate slightly off-center, slits can be made directly over center with minimal inherent stress problems affecting product dispensing.

An achievement of material distribution, for example dispensing foods or art materials, can be uniformly dispensed from the novel invention's design and structure. Simple foods such as hot dogs with mustard can end up looking much more appetizing with a creative or uniform pattern dispensed over its visual surface, achieved by the control offered by the disclosed invention. The various slits contour and outline shaping (as shown throughout in FIGS. 5–10 discussed below), along with practice can make some very interesting dispensing patterns from the disclosed invention. Consumers can create different dispensing results of thick or thin lines and visuals and even form letters. Dispensing products which retain their shape after dispensing are visually rewarding. This type of product valve pattern enhancement of the invention can be used for product presentation or as a marketing tool for making products look extraordinary, to an endless variation of dispensable products valve-controlled in formation with easy clean up.

Figure 5:
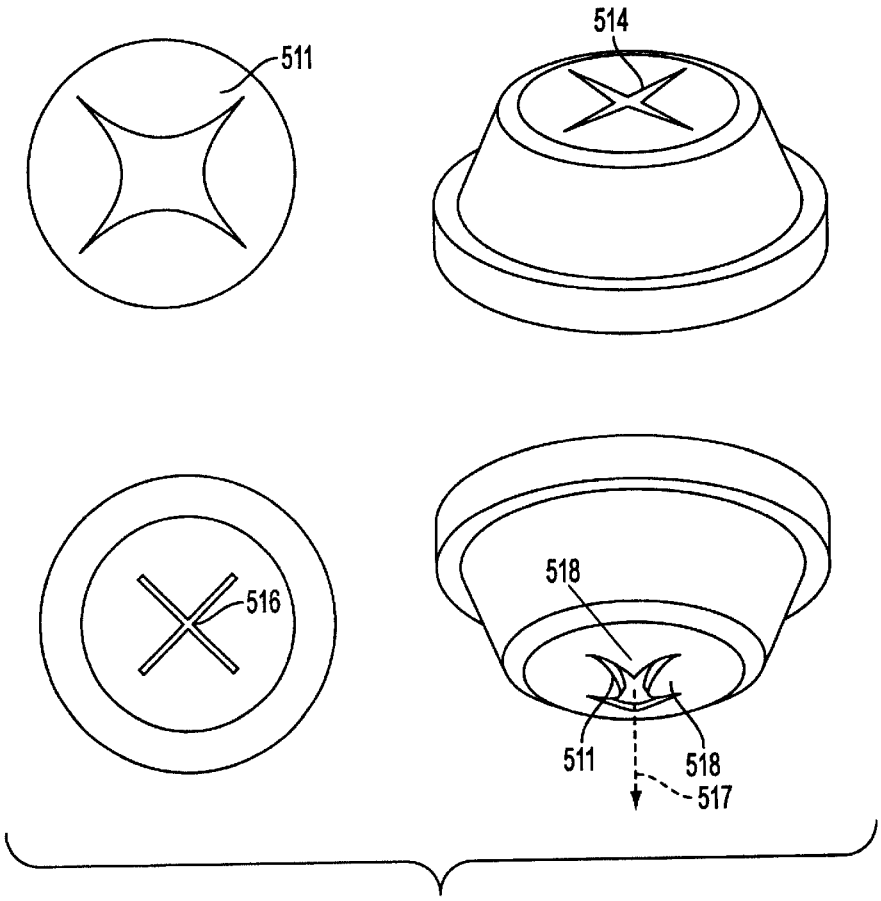
FIG. 5 shows an equalized dispensing controlled directional dispensing from a variation of the slitting formation of a valve.

For example, FIG. 5 shows equalized and controlled directional dispensing from a variation of the slitting formation of a valve with, for example, a straight line dispensing pattern (516) with equal, centered flaps (518), which are center-gated with equal slits (514), providing a straight line dispensing pattern with a dispensing shape (511) shown from the "living" hinges flexing. The figure shown is an example of the controlled directional dispensing (517) of material flow achieved with the injection molded valves. The sample dispensing shape (511) (as shown in this one sample embodiment) achieve equalized dispensing (517) with equal flaps (518) for the straight dispensing of material flow through valve equal slits (514) of this one sample embodiment. Centered flap(s) (518) achieve straight dispensing of material flow through this embodiment.

Figure 6:
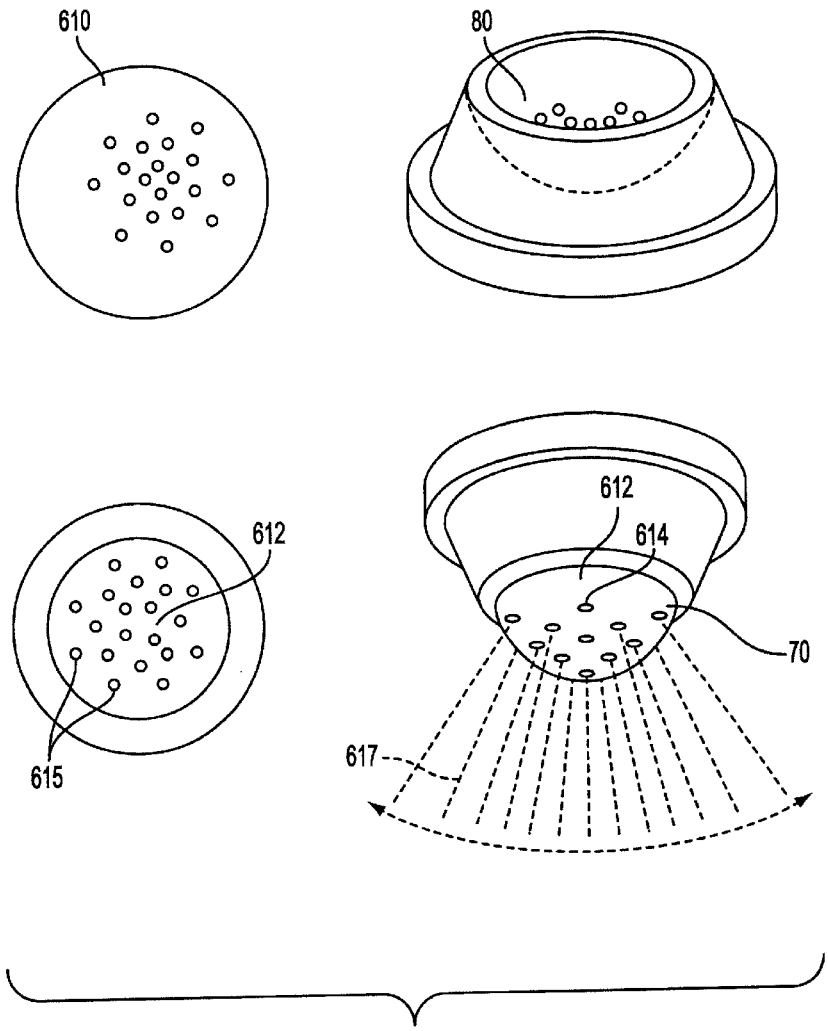
FIG. 6 shows a valve formation variation, with the valve initially concave.

FIG. 6 shows a valve formation variation, in which the valve is initially concave 610, and then expanding to a convex position. The concave valve (610) shape (80) embodiment has a center gate (612) embodiment with hole(s) (615). At a convex valve (70) position the holes (615) expand (614) flexibly such that material dispenses in an arc and to the sides move away from the center (617) this is because of the shape (610) of the valve.

Figure 7:
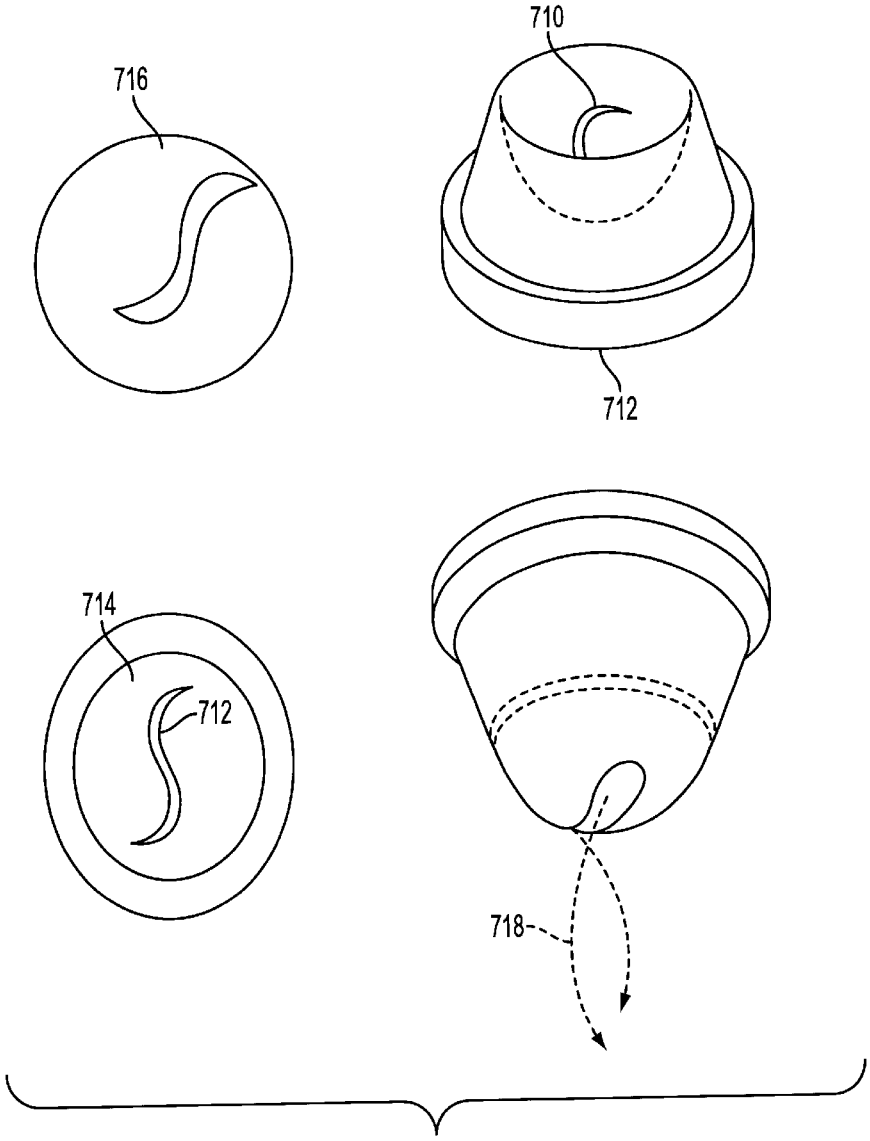
FIG. 7 shows a valve formation variation, with the valve with curved slits for a dispensing shape to create, for example, a spiral dispensing pattern from a valve.

For example, FIG. 7 shows a valve formation variation, with the valve having curved slits for a dispensing shape to create, for example, a spiral dispensing pattern from a valve; the FIG. 7 showing a curved slits embodiment to create spiral dispensing patterns. By having a curved shaped center gate (710) with a weak side (712) and a strong side (714) of varying thickness or, in another example, consistent thickness and varying the durometer of the material as well as the unique dispensed shape embodiment (716) shown here as dispensing (718) with expanded from unequal curved flaps creating a twisting action on material flow in this sample embodiment.

In one embodiment, the valve cover cap is designed to enable a reverse air flow to enter the container when the cover cap is in the closed position, as shown in FIG. 4 (430). This one way directional airflow of the disclosed invention eliminates the problem of flexible walled containers being distorted and held in a concave position or what is known in the art as paneling. This challenging problem is sometimes caused by hot-filled products which are sealed in airtight containers and experience radical temperature changes. This type of problem can also be created by altitude changes. After consumers dispense product and snap the cover cap over the valve before the container walls are fully recovered, the inward airflow continues into the valve. The valve, cap and hinge design allows the container and valve walls to completely recover in the disclosed invention.

While the preferred and alternate embodiments of the invention have been depicted in detail, modifications and adaptations may be made thereto, without departing from the spirit and scope of the invention, as delineated in the following claims:

1. A closure for a container having container walls, said closure comprising:

a base for attachment to a container and having a discharge opening through which product stored within said container is dispensed, said base having a lower end for attachment to a container and an upper end opposite thereto;

a cap joined to said base at said upper end and movable relative to said base between an opened and a closed position, said cap having a plug portion;

a hinged flexible valve shaped to selectively seal the discharge opening, said flexible valve having valve opening walls that separate to define a valve opening; and an air passage defined between said cap and said flexible valve when said cap is in the closed position;

wherein when said cap is in the open position and squeezing pressure is applied to said container walls, said flexible valve hingedly extends from an inwardly-directed storage position to an outwardly-directed dispensing position relative to said upper end of said base to allow product to be dispensed through said discharge opening and said valve opening;

wherein when said squeezing pressure is released and a vacuum is created in said container, said flexible valve cap hingedly retracts toward said closed position and dispensed product is drawn back through said valve opening via an inward flexing of said valve opening walls, thus rendering the flexible valve self-cleaning; and wherein when said cap is in the closed position, said plug portion abuts said flexible valve while said flexible valve is in said storage position and thereby prevents said flexible valve from extending toward said dispensing position and prevents product from being dispensed through said valve opening, said valve opening walls capable of flexing inwardly while said cap is in the closed position to allow for the one-way passage of air from the outside through said air passage and into a container to equalize any remaining vacuum present within said container resulting from the release of squeezing pressure on a container.

2. The closure of claim 1, wherein said hinged flexible valve further comprises a plurality of concentric circular sections forming connecting circular hinges controlled with pressure applied to a container.

3. The closure of claim 2, further comprising at least three concentric circular sections.

4. The closure of claim 1, wherein said hinged flexible valve is formed from a thermoplastic elastomeric material.

5. The closure of claim 1, wherein said hinged flexible valve is made of a low durometer material.

6. The closure of claim 1, wherein at least one valve opening wall is stronger than at least one other valve opening wall such that product is dispensed through said valve opening in a non-uniform manner relative to said valve opening.

7. The closure of claim 1, wherein said valve opening is not centered on said hinged flexible valve.

8. The closure of claim 1, wherein said valve opening walls are defined by one of a flap, a finger, or a slit for guiding product dispensed through said valve opening and for determining a flow pattern defined by said dispensed product.

9. The closure of claim 8, wherein said flow pattern comprises curves, lines, angles, and points.

10. The closure of claim 1, wherein said hinged flexible valve further comprises a gate placed at a center of said valve to produce equal stresses in product flow and wherein each of said valve opening walls has a consistent thickness.

11. The closure of claim 1, wherein said air passage extends from a joinder of said cap and said base.

12. The closure of claim 11, wherein said joinder is a flexible hinge.

13. A container having container walls and a closure, said closure comprising:

a base for attachment to said container and having a discharge opening through which product stored within said container is dispensed, said base having a lower end for attachment to said container and an upper end opposite thereto;

a cap joined to said base at said upper end and movable relative to said base between an opened and a closed position, said cap having a plug portion;

a hinged flexible valve shaped to selectively seal the discharge opening, said flexible valve having valve opening walls that separate to define a valve opening; and an air passage defined between said cap and said flexible valve when said cap is in the closed position;

wherein when said cap is in the open position and squeezing pressure is applied to said container walls, said flexible valve hingedly extends from an inwardly-directed storage position to an outwardly-directed dispensing position relative to said upper end of said base to allow product to be dispensed through said discharge opening and said valve opening;

wherein when said squeezing pressure is released and a vacuum is created in said container, said flexible valve cap hingedly retracts toward said closed position and dispensed product is drawn back through said valve opening via an inward flexing of said valve opening walls, thus rendering the flexible valve self-cleaning; and wherein when said cap is in the closed position, said plug portion abuts said flexible valve while said flexible valve is in said storage position and thereby prevents said flexible valve from extending toward said dispensing position and prevents product from being dispensed through said valve opening, said valve opening walls capable of flexing inwardly while said cap is in the closed position to allow for the one-way passage of air from the outside through said air passage and into said container to equalize any remaining vacuum present within said container resulting from the release of squeezing pressure on said container.

14. The container of claim 13, wherein said hinged flexible valve further comprises a plurality of concentric circular sections forming connecting circular hinges controlled with pressure applied to a container.

15. The container of claim 14, further comprising at least three concentric circular sections.

16. The container of claim 13, wherein said hinged flexible valve is formed from a thermoplastic elastomeric material.

17. The container of claim 13, wherein said hinged flexible valve is made of a low durometer material.

18. The container of claim 13, wherein at least one valve opening wall is stronger than at least one other valve opening wall such that product is dispensed through said valve opening in a non-uniform manner relative to said valve opening.

19. The container of claim 13, wherein said valve opening is not centered on said hinged flexible valve.

20. The container of claim 13, wherein said valve opening walls are defined by one of a flap, a finger, or a slit for guiding product dispensed through said valve opening and for determining a flow pattern defined by said dispensed product.

21. The container of claim 20, wherein said flow pattern comprises curves, lines, angles, and points.

22. The container of claim 13, wherein said hinged flexible valve further comprises a gate placed at a center of said valve to produce equal stresses in product flow and wherein each of said valve opening walls has a consistent thickness.

23. The container of claim 13, wherein said air passage extends from a joinder of said cap and said base.

24. The container of claim 23, wherein said joinder is a flexible hinge.

* * * * *